US008268022B2

(12) United States Patent
Sloan

(10) Patent No.: US 8,268,022 B2
(45) **Date of Patent: *Sep. 18, 2012**

(54) UNIVERSAL SYNTHETIC GASOLINE FUEL CONDITIONER ADDITIVE, METHOD AND PRODUCT-BY-PROCESS

(75) Inventor: Ronald J. Sloan, Blaine, WA (US)

(73) Assignee: Bestline International Research, Inc., Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/093,223

(22) Filed: Apr. 25, 2011

(65) Prior Publication Data

US 2011/0197499 A1 Aug. 18, 2011

Related U.S. Application Data

(63) Continuation of application No. 12/747,230, filed as application No. PCT/US2008/087433 on Dec. 18, 2008, now Pat. No. 7,931,704, and a continuation-in-part of application No. 11/290,596, filed on Dec. 1, 2005, now Pat. No. 7,745,382, said application No. 12/747,230 is a continuation of application No. 12/060,637, filed on Apr. 1, 2008, now Pat. No. 8,022,020, and a continuation-in-part of application No. 12/747,227, filed as application No. PCT/US2007/088252 on Dec. 19, 2007, now Pat. No. 8,062,388, said application No. 12/747,230 is a continuation-in-part of application No. 12/808,495, filed as application No. PCT/US2008/050951 on Jan. 13, 2008, now Pat. No. 8,071,522.

(60) Provisional application No. 60/644,494, filed on Jan. 18, 2005.

(51) Int. Cl.
*C10L 1/18* (2006.01)

(52) U.S. Cl. ..... 44/451; 44/370; 44/434; 44/437; 44/459

(58) Field of Classification Search ..... 44/451, 44/434, 370, 437, 459
See application file for complete search history.

(56) References Cited

U.S. PATENT DOCUMENTS

| | | | |
|---|---|---|---|
| 3,406,419 | A | 10/1968 | Young |
| 3,984,599 | A | 10/1976 | Norton |
| 4,127,491 | A | 11/1978 | Reick |
| 4,131,551 | A | 12/1978 | Thompson et al. |
| 4,218,330 | A | 8/1980 | Shubkin |
| 4,224,173 | A | 9/1980 | Reick |
| 4,228,021 | A | 10/1980 | Lenack |
| 4,375,418 | A | 3/1983 | Zoleski et al. |
| 4,443,348 | A | 4/1984 | Wright et al. |
| 4,504,404 | A | 3/1985 | Schumacher et al. |
| 4,534,873 | A | 8/1985 | Clark |
| 4,844,825 | A | 7/1989 | Sloan |
| 4,859,359 | A | 8/1989 | DeMatteo et al. |
| 4,956,122 | A | 9/1990 | Watts et al. |
| 5,120,358 | A | 6/1992 | Pippett |
| 5,136,118 | A | 8/1992 | Buchanan et al. |
| 5,202,040 | A | 4/1993 | Sanderson et al. |
| 5,332,516 | A | 7/1994 | Stephens |
| 5,364,994 | A | 11/1994 | Scharf |
| 5,431,841 | A | 7/1995 | Lockhart |
| 5,631,211 | A | 5/1997 | Nakagawa et al. |
| 5,672,572 | A | 9/1997 | Arai et al. |
| 5,681,797 | A | 10/1997 | Lawate |
| 5,741,764 | A | 4/1998 | Patel et al. |
| 5,885,942 | A | 3/1999 | Zhang et al. |
| 5,972,853 | A | 10/1999 | Boffa et al. |
| 6,008,164 | A | 12/1999 | Aldrich et al. |
| 6,046,142 | A | 4/2000 | Zilonis et al. |
| 6,074,993 | A | 6/2000 | Waddoups et al. |
| 6,143,701 | A | 11/2000 | Boffa |
| 6,413,916 | B1 | 7/2002 | Baumgart et al. |
| 6,761,645 | B1 | 7/2004 | Weber |
| 6,774,091 | B2 | 8/2004 | Dituro et al. |
| 6,858,567 | B2 | 2/2005 | Akao |
| 6,919,300 | B2 | 7/2005 | Dituro |
| 6,962,895 | B2 | 11/2005 | Scharf et al. |
| 6,992,049 | B2 | 1/2006 | Deckman et al. |

(Continued)

FOREIGN PATENT DOCUMENTS

| | | | |
|---|---|---|---|
| DE | 19723460 | A1 | 1/1998 |

(Continued)

OTHER PUBLICATIONS

Rudnick, Leslie R., Ed., Synthetic Mineral Oils and Bio Based Lubricants: Chemistry and Technology, Taylor & Francis (2006).

Journal of Automotive Engineering, May 1, 2001, vol. 55, No. 5, pp. 67-72.

Journal of Automotive Engineering, May 1, 2001, vol. 55, No. 5, pp. 67-72, English translation of: p. 70, last paragraph; Figures 6 and 7.

*Primary Examiner* — Cephia D Toomer

(74) *Attorney, Agent, or Firm* — Jay R. Yablon

(57) ABSTRACT

A process of producing a universal synthetic based gasoline fuel additive that cleans the fuel system including valves surface, lubricates the fuel pump, injectors and valves while allowing for a clean and more efficient burn. A major portion will consist of (a) Alfa-Olefins, (b) 2-propanol (c) Hydroisomerized High VI HT Base Oils, (d) Dimethyl Ketones, (e) Low Flash Mineral Spirits, (f) Low Aromatic Solvent, (g) Isomer Reformate, (h) Solvent Activated Dye. In a preferred embodiment, this universal synthetic gasoline conditioner additive for improving lubrication comprises: alpha-olefins comprising from 5 to 30 percent thereof, by weight; low odor aromatic solvents comprising from 3 to 27 percent thereof, by weight; 2-Propanol comprising of 3 to 30 percent thereof, by weight; and at least one a base oil comprising from 0.50 to 15 percent thereof, by weight; wherein: the percentages by weight are specified in relative proportion to one another.

29 Claims, No Drawings

U.S. PATENT DOCUMENTS

| | | | | |
|---|---|---|---|---|
| 7,018,960 | B2 | 3/2006 | Negoro et al. | |
| 7,022,766 | B2 | 4/2006 | Okada et al. | |
| 7,055,534 | B2 | 6/2006 | Goode et al. | |
| 7,109,152 | B1 | 9/2006 | Corby et al. | |
| 7,124,728 | B2 | 10/2006 | Carey et al. | |
| 7,745,382 | B2 | 6/2010 | Sloan | |
| 7,931,704 | B2 * | 4/2011 | Sloan | 44/451 |
| 8,022,020 | B2 | 9/2011 | Sloan | |
| 8,039,424 | B2 | 10/2011 | Sloan | |
| 8,062,388 | B2 | 11/2011 | Sloan | |
| 8,071,513 | B2 | 12/2011 | Sloan | |
| 8,071,522 | B2 | 12/2011 | Sloan | |
| 2003/0040444 | A1 | 2/2003 | Garmier | |
| 2003/0087769 | A1 | 5/2003 | Dituro et al. | |
| 2004/0014613 | A1 | 1/2004 | Dituro et al. | |
| 2004/0060229 | A1 | 4/2004 | Todd et al. | |
| 2004/0077506 | A1 | 4/2004 | Arrowsmith et al. | |
| 2006/0160708 | A1 | 7/2006 | Sloan | |
| 2008/0182769 | A1 | 7/2008 | Sloan | |
| 2008/0190014 | A1 | 8/2008 | Volkel et al. | |
| 2010/0261626 | A1 | 10/2010 | Sloan | |
| 2010/0273687 | A1 | 10/2010 | Sloan | |
| 2010/0273688 | A1 | 10/2010 | Sloan | |
| 2011/0009301 | A1 | 1/2011 | Sloan | |
| 2011/0015103 | A1 | 1/2011 | Sloan | |
| 2011/0197499 | A1 | 8/2011 | Sloan | |

FOREIGN PATENT DOCUMENTS

| | | | |
|---|---|---|---|
| EP | 0361180 | A1 | 4/1990 |
| EP | 0837122 | A2 | 4/1998 |
| EP | 1203803 | A1 | 5/2002 |
| EP | 1736529 | A1 | 12/2006 |
| FR | 2193080 | | 7/1972 |
| JP | 59204700 | | 11/1984 |
| JP | 07233001 | | 9/1995 |
| JP | 2001-271077 | A | 10/2001 |
| WO | 9719153 | | 5/1997 |
| WO | 0234867 | A1 | 5/2002 |
| WO | 033064571 | A1 | 8/2003 |
| WO | 2006-015800 | A1 | 2/2006 |
| WO | 2006100188 | A1 | 9/2006 |
| WO | 2007004789 | A1 | 1/2007 |
| WO | 2009078882 | A1 | 6/2009 |
| WO | 2009079020 | A1 | 6/2009 |
| WO | 2009085957 | A1 | 7/2009 |
| WO | 2009085967 | A1 | 7/2009 |

* cited by examiner

UNIVERSAL SYNTHETIC GASOLINE FUEL CONDITIONER ADDITIVE, METHOD AND PRODUCT-BY-PROCESS

CROSS-REFERENCE TO RELATED APPLICATIONS

This application is a continuation of U.S. application Ser. 12/747,230 filed Jun. 10, 2010, now U.S. Pat. No. 7,931,704 issued Apr. 26, 2011. Said U.S. Ser. No. 12/747,230 is a U.S. National Stage application based on PCT/US08/87433 filed Dec. 18, 2008. Said U.S. Ser. No. 12/747,230 is also a continuation in part of U.S. application Ser. No. 11/290,596 filed Dec. 1, 2005, now U.S. Pat. No. 7,745,382 issued Jun. 29, 2010. Said U.S. Ser. No. 11/290,596 claims benefit of provisional application U.S. 60/644,494 filed Jan. 18, 2005. Said U.S. Ser. No. 12/747,230 is also: a continuation of pending application U.S. Ser. No. 12/060,637 filed Apr. 4, 2008; a continuation in part of PCT/US07/88252 filed Dec. 19, 2007 which entered the US as pending U.S. application Ser. No. 12/747,227 filed Jun. 10, 2010; and a continuation in part of PCT/US08/50951 filed Jan. 13, 2008 which entered the US as pending application Ser. No. 12/808,495 filed Jun. 16, 2010.

FIELD OF THE INVENTION

The field of invention relates to the latest technology in the development of a synthetic gasoline conditioner to clean and lubricate the fuel pump, injectors and valves.

BACKGROUND OF THE INVENTION

Over the years, gasoline has been subject to environmental pressures to reduce emissions from the exhaust pipe. Various chemicals such as MTBE (Methyl Tertiary Butyl Ether) have been introduced to gasoline, only to discover later that the residue was showing potential long-term harmful effects on the ground water system. Grain alcohol, ethanol is now the latest ingredient to be added to gasoline. Unfortunately, unlike MTBE, ethanol when added to gasoline to satisfy the oxygen content required, raises the Reid vapor pressure (RVP) of the blend by 1 psi, making it difficult for ethanol blends to meet VOC performance standards. With introduction of oxygenates such as MTBE and ethanol, many vehicles have experienced premature wear in high pressure fuel pumps required for fuel injections systems, injectors and valve guides. The oxygenates dries the fuel creating premature wear between the moving components and in such component as injectors where premature wear can allow excess fuel to discharge causing unburned fuel to be exhausted into the atmosphere. The results are twofold: (1) the environmental effect and (2) the cost to the operators for fuel loss or poor fuel mileage.

The invention disclosed herein has been extensively tested experimentally. These test show that it meets is its primary purpose which is to lubricate the fuel system to reduce wear of the mechanical components, which over time will restore injectors' impulse movement required to maintain the greatest fuel efficiencies. The invention will not, however, restore broken components or components that have suffered severe wear. The invention incorporates a strong element of extreme pressure lubrication, octane booster, detergent, dicing agent and cleaner that cleans and restores the valve surface. In-house testing on stationary engines under load have demonstrated increased run time as high as 12% on fuel treated with the invention.

As of December 2007, United States requires that fuel mileage per gallon must be increased while emissions must be reduced. The challenge will fall upon the manufacture of the fuel supply, automakers and the engine lubricants. The invention will have a beneficial impact on meeting these requirements put forward by the United States government.

Ecological tests were run in California to test the fuel with an Environmental Protection Agency (EPA) designed and approved test protocol. The tests were to demonstrate that the lubricant within the invention, which has been offset by other chemical components, would not have a negative effect on the emissions.

The results of the EPA approved tests demonstrated that the invention, when added to gasoline, did not alter or have a negative effect upon the readings previously registered when tested with gasoline untreated. These tests included readings for; non methane organic gas (NMHC); nitrogen oxide (NOX); carbon monoxide (CO2); total hydro carbons (THC) and carbon dioxide (CO). The concern of the EPA has always been that adding a lubricant to any kind of gasoline would have a serious negative upon the emissions, and these tests have demonstrated that this invention does not.

SUMMARY OF THE INVENTION

Disclosed herein is a synthetic gasoline conditioner additive with strong lubrication characteristics to reduce premature mechanical wear and failure, increased octane, while cleaning and restoring the valves face to a more efficient operation., the process for producing said lubricant, and the method of using said lubricant. This lubricant comprises alpha-olefins;

low odor aromatic solvents; and at least one a base oil selected from the base oil group consisting of hydroisomerized high base oils and HT Severe Hydro-cracked Base Oils; as well as other ingredients. Also disclosed is a method for producing this fuel conditioner and lubricant additive.

In a preferred embodiment, this universal synthetic gasoline conditioner additive for improving lubrication comprises: alpha-olefins comprising from 5 to 30 percent thereof, by weight; low odor aromatic solvents comprising from 3 to 27 percent thereof, by weight; 2-Propanol comprising of 3 to 30 percent thereof, by weight; and at least one a base oil comprising from 0.50 to 15 percent thereof, by weight; wherein: the percentages by weight are specified in relative proportion to one another.

DETAILED DESCRIPTION

The invention relates to the use of a synthetic gasoline conditioner additive containing a lubricant which that can be added to gasoline fuels stocks to replace the dramatic loss of lubrication generally associated with oxygenated enhanced fuels. The product will have utility in all forms and grades of gasoline, gasoline engines, naturally aspirated or turbocharged where oxygenated fuels will result in premature wear to the integral components of internal combustion engine. The invention has been submitted by confidential disclosure to the EPA and has received registration under 40CFR 79.23 in October 2007.

Previous gasoline stocks relied upon lead to offer lubrication to mechanical components and valve facings, which is now highly restricted by the United States Environmental Protection Agency and various foreign governments. With the new universal environmental standards, oxygenated compounds will become widely used throughout the world to hopefully have a positive impact on the environment and greenhouse gasses.

Primary Ingredients

The finished product (preferred embodiment of the invention) is a combination of:

Alpha-Olefins (PAO): PAO is a primary ingredient also known as Alkenes, Polymerized, Chlorowax Liquids, and Chlorinated Paraffins whose carbon chain length are 12 to 24 with chloric weight percentage from 21.4 to 70%, an HCI of 4 to 10 ppm and molecular weight of 273.5 to 650 and Wt. C1 (2) from 20 to 70% with specific gravity at 25 degrees centigrade of 1.050 to 1.50 and a JQD weight percentage of HCL being 0.20 to 0.60 maximum. The primary use is for the above ingredient is for lubricant formulations, lubricant additive compounds, extreme-pressure additive formulations and for metal working compounds. Further, alpha-olefins or associated products reduce the growth of algae in fuel as aging or excessive moisture accumulates and stabilize the fuel over time while providing extreme lubrication to the fuel system and the firing chamber of the engine. This provides the lubrication lacking in ultra low sulfur diesel.

Low Odor Aromatic Solvents: This is a primary ingredient which is a highly-refined, low toxic, low-odor solvent ideal for paints, varnishes, food grade coatings, adhesives, diluents, thinners, agrochemicals, household pesticides, spray oils and specialty chemicals. Aromatic percentage is 5 to 40% (EC-A-G04), a flash point of 20 to 80 degrees centigrade (ASTM D-93) and a density at 30 degrees centigrade (plus/minus) 0.600 to 0.900 (ASTM D-4052).

Hydroisomerized High-Base Oils or HT Severe Hydrocracked Base Oils: This primary ingredient is a severe hydro-cracked or hydroisomerized base oil with low or no aromatics and impurities achieved by chemically reacting the feed stock with hydrogen to reduce or remove polar compounds containing sulphur, nitrogen and oxygen and to convert aromatic hydrocarbons to saturated cyclic hydrocarbons breaking up the heavy polycyclo-paraffin molecules to light saturated hydrocarbons. This may include fractionated oils that have been hydro-finished or hydro-polished. The base oils can be used in a host of lubricating oils, motor oils, cutting oils, food processing, pharmaceutical, industry, agriculture lubricants and extreme pressure additives. These add to the lubrication of ultra synthetic gasoline conditioner.

2-Propanol: This known as Isopropanol Alcohol (IPA) or industrial alcohol 2-Propanol and is a colorless, flammable chemical compound with a chemical formula of C3H8O. The compound has a Molar Mass of 60.10 g/mol; density of 0.785 g/cm3, liquid; dipole moment of 1.66 D (gas); viscosity of 2.86 cP at 15 degrees centigrade and 1.77 cP at 30 degrees centigrade and related to 1-propanol and ethanol. Isopropanol is known to solubilize water and as an insoluble water, it will no long freeze. Being a secondary alcohol, isopropanol can be oxidized within the ketone acetone of the invention.

Other Ingredients

Octane Booster and Detergent Blend: In accordance with this invention, this is a blend comprising: hydrocarbon solvents, CAS 64741-86-2; petroleum naphtha, CAS 64742-94-5; polyether amine; and said naphthalene, CAS 91-20-3. It may also contain 2-Ethylhexyl Nitrate with suggested percentage of 10 to 30% by weight, particularly where calcium sulfonates are restricted, see below. This group of compounds when blended together will clean and maintain the firing chamber of the engine, increase the octane while neutralizing any acids within the fuel system and firing chamber.

Synthetic Calcium Sulfonates: An over-based synthetic calcium sulfonate with a TBN of 100 to 600 whose primary purpose is for extreme pressure additive formulations offering corrosion protection, dispersants and detergency in oil soluble additives for ferrous and non-ferrous metals with a minimum calcium weight of 10.00 to 20.00%, a total base number, mg KOH/g (ASTM D-2896) of 200 to 600 and an average molecular weight (ASTM d-3712) of 800 to 1200. Important note: in December 2007, a new United States law was enacted which may restrict the future use of calcium sulfonates in fuel additives, and so at least the United States, it may become necessary to omit this ingredient from the invention. This is possible, because the 2-Ethylhexyl Nitrate above serves a similar corrosion protection, dispersant and detergency function.

Low Flash Mineral Spirits: Referred to as Stoddard Solvent and/or White's Spirits, this is commonly used as an extraction solvent, cleaning solvent, solvent in aerosols, paints, lacquers, varnishes and paint thinners for household and commercial use and has been subjected to hydrodesulfurization solvent extraction with a mixture of saturated aliphatic and alicyclic C7-C12 with a maximum of 40%. The flash point ranges from 15 to 40 degrees centigrade, aniline point of 50 to 80 degrees centigrade, vapor density of 3.5 to 6.0 (air be 1) and viscosity (cps. 25 degrees centigrade) 0.70 to 1.75. As a cleaning solvent it cleans components within the fuel system.

Solvent activated dyes: These are commonly used to identify grades or designated uses of fuels and lubricants. They are produced in both powder and liquid form and when introduced to the product are stable and leave an identifiable color to the product.

Pour Point Depressants or Cloud Point Depressants: These are used to reduce agglomeration or massing together of wax crystals in paraffin compounds such as lubricants and diesel fuel.

Isomer Reformate: Also referred to as a Solvent, Toluene, Toluol, Methylbenzene and Phenylmethane with a chemical formula of C7H8 (C6H5CH3) and a CAS No. 108-88-3, a molecular weight of 90.00 to 95.00 g/mole and a specific gravity of 0.800 to 0.900 (water being 1). The chemical is an aromatic hydrocarbon that is widely used as an industrial feedstock and as a solvent for cleaning the fuel systems, holding tanks and the combustion chamber of the engine.

Dimethyl Ketones: Also referred to as Acetone or 2-propanone with molecular structure of CH3COCH3. It is colorless, has low boiling point, and is miscible in proportions with water, alcohols, most hydrocarbons and other organic liquids including diesel fuel stocks to help clean and reduce carbon build up on valves and piston tops.

Preferred Blending Ratios

The preferred blending Ratios for each component are shown as below. It is important to maintain a blend of component that fall within the following percentages. These percentages by weight are specified in relative proportion to one another. Therefore, in the event one or more of the ingredients shown below is omitted from the synthetic gasoline conditioner additive, the percentages by weight of the remaining ingredients are proportionately increased:

Alpha-Olefins: 5 to 30% by weight and preferably 7.0 to 25% by weight and more preferably 9.0 to 18% by weight. Most preferable is 10.45% by weight.

Low Odor Aromatic Solvents: 3.0 to 27% by weight and preferably 5.0 to 22% by weight and more preferably is 7.0 to 18% by weight. Most preferable is 7.50% by weight.

Hydroisomerized High-Base Oils or HT Severe Hydrocracked Base Oils: 0.50 to 15 percent by weight and preferably 0.75 to 8% by weight and more preferably 1.0 to 4.0% by weight. Most preferable is 1.52% by weight.

2-Proponal: 5-40% by weight and preferably 7-30% by weight and more preferably 12 to 24% by weight. Most preferable is 18.5%

Octane Booster, Detergent and Acid Neutralizer Blend: 0.30 to 7.5% by weight and preferably 0.50 to 5.0% by weight and more preferably 0.75 to 2.5% by weight. Most preferable is 1.0% by weight.

Synthetic Calcium Sulfonates: 0.05 to 0.25% by weight, preferably 0.07 to 0.20% by weight and more preferably 0.10 to 0.18% by weight. Most preferable is 0.125% by weight.

Low Flash Mineral Spirits: 15 to 50% by weight and preferably 20 to 45% by weight and more preferably 25-39% by weight. Most preferable is 33.5% by weight.

Solvent Activated Dyes: 0.002 to 0.005 percent by weight and preferably 0.0025 to 0.004% by weight and more preferably 0.027 to 0.035% by weight. Most preferable is 0.003 percent by weight.

Isomer Reformate: 0.50 to 15.0% by weight and preferably 1.50 to 10% by weight and more preferably 2.5 to 7.0% by weight. Most preferable is 4.0% by weight.

Dimethyl Ketones: 10 to 50% by weight and preferably 17 to 40% by weight and more preferably 24 to 28% by weight. Most preferable is 23.4%.

Preferred Sequence of Blending Components

The initial blend (primary blend) will require the Poly Alpha Olefins, the Low Aromatic Solvent and the Base Oil being blended until the liquid is a consistent amalgamation without any appearance of separation. Blending is based on speed of the agitator and temperature will dictate the amount of time for the blend to complete. The blending time range may vary from 2 to 4 hours. The ideal temperature for each component is between 22 to 30 degrees centigrade for ideal blending. While this is blending, a secondary blend for the Octane Booster, Detergent and Acid Neutralizer, 2-Propanol and said Dimethyl Ketones at 25/75 ratio can be prepared in a smaller high speed enclosed blender, and then added to the main blend.

If the synthetic calcium sulfonates are employed (noting the recent U.S. law which could restrict their use in the U.S.), blending will require that the synthetic calcium sulfonates be blended with the mineral spirits in an approximate 50/50 ratio in the initial stage of the blend to produce a tertiary blend. (The mineral spirits used will be from the preferred percentage set forth earlier.) This tertiary blend, or the mineral spirits alone absent the synthetic calcium sulfonates, together with the balance of the ingredients, can be then added to the main blend and the agitator is run until the components appear to have thoroughly blended into a consistent liquid.

Preferred Blend Equipment

The Process sequence involves a series of blending and holding tanks where the product can be weighed and then pumped through control valves to maintain consistent flow and pressure. The blending should be performed in a enclosed tank to reduce product evaporation (loss) and prevent exposure to open spark. Blending equipment can be by a combination of high or low speed blending apparatus. Size or volume of tank is not critical to the blend.

Universal Use of Invention

The product has been put to experimental test in various on-road, off-road vehicles, marine and industrial engines have demonstrated that when added at 2 to 3 ounces per 10 gallons with all grades of gasoline including those containing grain alcohol, reduced wear, increased mileage and reduced emissions have been experienced, as summarized below.

Testing Procedures

The only protocol for testing fuel /mileage is in the hands of the U.S. EPA and is being revamped at the time of the filing of this application. The current tests are completed under conditions that the average person would find it nearly impossible to replicate in either city or highway driving. The main criteria, was to measure the emission from the exhaust system to establish if the invention has a negative impact on the emission standards as set by the EPA. The Inventor subjected the invention to the EPA approved and registered test in 2007. The resulting tests displayed no negative impact on THC, CO, NOX, CO, CO2 and NMNC. Further the invention was registered in October of 2007 with the EPA under 40CFR 79.21 (f). Further tests were conducted on stationary generators with controlled load factors. The engines were run measuring fuel which was both treated and untreated, and the results analyzed. The engines were engines without an OB computer system so accurate reading of fuel consumption was measured. The resulted demonstrated that the treated fuel ran for an average consistently of 12% longer over the untreated fuel.

The knowledge possessed by someone of ordinary skill in the art at the time of this disclosure is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicant's combination and cannot be omitted. It is further understood that the related prior art may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A universal synthetic gasoline conditioner additive product-by-process, produced by a method comprising:

blending polymerized alpha-olefins, low odor aromatic solvents, 2-Propanol, and at least one base oil selected from the base oil group consisting of hydroisomerized base oils and severe hydro-cracked base oils, until the blend is a consistent amalgamation without any appearance of separation, thereby producing a primary blend;

separately, blending an octane booster, detergent, acid neutralizer blend, thereby producing a secondary blend; and adding said secondary blend to said primary blend.

2. The product-by-process of claim 1, said method further comprising adding low flash mineral spirits to said primary and secondary blend.

3. The product-by-process of claim 2, wherein said low flash mineral spirits have been subjected to hydrodesulfurization.

4. The product-by-process of claim 1, said method further comprising:

separately blending synthetic calcium sulfonates and low flash mineral spirits, thereby producing a tertiary blend; and adding said tertiary blend to said primary and secondary blend.

5. The product-by-process of claim 4, wherein said low flash mineral spirits have been subjected to hydrodesulfurization.

6. The product-by-process of claim 2, said method further comprising adding at least one depressant; isomer reformate; and dimethyl ketones to the blend of primary and secondary blends and low flash mineral spirits.

7. The product-by-process of claim 6, said at least one depressant selected from the group consisting of pour point depressants and cloud point depressants.

8. The product-by-process of claim 4, said method further comprising adding at least one depressant; isomer reformate; and dimethyl ketones to said primary, secondary, and tertiary blends.

9. The product-by-process of claim 8, said at least one depressant selected from the group consisting of pour point depressants and cloud point depressants.

10. The product-by-process of claim 6, said method further comprising adding solvent activated dyes to the blend of primary and secondary blends and low flash mineral spirits.

11. The product-by-process of claim 8, said method further comprising adding solvent activated dyes to said primary, secondary, and tertiary blends.

12. A universal synthetic gasoline conditioner additive product-by-process, produced by a method comprising:

blending polymerized alpha-olefins, low odor aromatic solvents, 2-Propanol, and at least one base oil selected from the base oil group consisting of hydroisomerized base oils and severe hydro-cracked base oils, until the blend is a consistent amalgamation without any appearance of separation, thereby producing a primary blend; and adding polyether amine to said primary blend.

13. The product-by-process of claim 12, said method further comprising:

adding said polyether amine to said primary blend by separately blending said polyether amine; petroleum naphtha;

naphthalene; and hydrocarbon solvent, thereby producing a secondary blend; and adding said secondary blend to said primary blend.

14. The product-by-process of claim 12, said method further comprising:

separately blending 2-ethylhexyl nitrate; petroleum naphtha; naphthalene; and hydrocarbon solvent, thereby producing a secondary blend; and adding said secondary blend to said primary blend.

15. The product-by-process of claim 14, said method further comprising:

adding low flash mineral spirits to said primary and secondary blend.

16. The product-by-process of claim 14, said method further comprising:

separately blending synthetic calcium sulfonates and low flash mineral spirits, thereby producing a tertiary blend; and adding said tertiary blend to said primary and secondary blend.

17. The product-by-process of claim 15, said method further comprising:

adding solvent activated dyes; at least one depressant selected from the group consisting of pour point depressants and cloud point depressants; isomer reformate; and dimethyl ketones, to said blend of primary and secondary blends, and said low flash mineral spirits.

18. The product-by-process of claim 16, said method further comprising:

adding solvent activated dyes; at least one depressant selected from the group consisting of pour point depressants and cloud point depressants; isomer reformate; and dimethyl ketones, to said primary, secondary, and tertiary blends.

19. A method of producing a universal synthetic gasoline conditioner additive, comprising:

blending polymerized alpha-olefins, low odor aromatic solvents, 2-Propanol, and at least one base oil selected from the base oil group consisting of hydroisomerized base oils and severe hydro-cracked base oils, until the blend is a consistent amalgamation without any appearance of separation, thereby producing a primary blend;

separately, blending an octane booster, detergent, acid neutralizer blend, thereby producing a secondary blend; and adding said secondary blend to said primary blend.

20. The method of claim 19, said method further comprising adding low flash mineral spirits to said primary and secondary blend.

21. The method of claim 20, wherein said low flash mineral spirits have been subjected to hydrodesulfurization.

22. The method of claim 19, said method further comprising:

separately blending synthetic calcium sulfonates and low flash mineral spirits, thereby producing a tertiary blend; and adding said tertiary blend to said primary and secondary blend.

23. The method of claim 22, wherein said low flash mineral spirits have been subjected to hydrodesulfurization.

24. The method of claim 20, said method further comprising adding at least one depressant; isomer reformate; and dimethyl ketones to the blend of primary and secondary blends an low flash mineral spirits.

25. The method of claim 24, said at least one depressant selected from the group consisting of pour point depressants and cloud point depressants.

26. The method of claim 22, said method further comprising adding at least one depressant; isomer reformate; and dimethyl ketones to said primary, secondary, and tertiary blends.

27. The method of claim 26, said at least one depressant selected from the group consisting of pour point depressants and cloud point depressants.

28. The method of claim 24, said method further comprising adding solvent activated dyes to the blend of the primary and secondary blends and low flash mineral spirits.

29. The method of claim 26, said method further comprising adding solvent activated dyes to said primary, secondary, and tertiary blends.

* * * * *